United States Patent [19]

Seto et al.

[11] 4,230,187

[45] Oct. 28, 1980

[54] METHODS AND APPARATUS FOR SENSING WELLHEAD PRESSURE

[75] Inventors: Rodney K. M. Seto, Missouri City; Eugene L. Brickman; Michael R. Fitzgibbons, both of Houston, all of Tex.

[73] Assignee: TRW Inc., Redondo Beach, Calif.

[21] Appl. No.: 50,072

[22] Filed: Jun. 19, 1979

[51] Int. Cl.[3] ..... E21B 43/01; F15B 20/00; F16K 17/36

[52] U.S. Cl. ..... 166/362; 166/65 R; 166/363; 137/458; 137/488

[58] Field of Search ..... 166/362, 363, 364, 336, 166/337, 65 R; 137/458, 461, 488, 492, 492.5, 2; 73/151

[56] References Cited

U.S. PATENT DOCUMENTS

| | | | |
|---|---|---|---|
| Re. 29,638 | 5/1978 | Nutter | 73/151 |
| 3,198,207 | 8/1965 | Willis et al. | 137/458 |
| 3,252,476 | 5/1966 | Page, Jr. | 137/458 |
| 3,338,302 | 8/1967 | Hubby | 166/363 X |
| 3,389,718 | 6/1968 | Johnson et al. | 137/458 X |
| 3,452,592 | 7/1969 | Voetter | 73/151 |
| 3,712,129 | 1/1973 | Rhoades | 73/151 |
| 3,898,877 | 8/1975 | McArthur | 73/151 |
| 3,920,040 | 11/1975 | Powell | 137/458 |
| 3,963,050 | 6/1976 | Theriot et al. | 137/458 X |
| 4,046,006 | 9/1977 | Dufrene | 73/151 |

OTHER PUBLICATIONS

Haskel Engineering & Supply Co., Bulletin M-38, "Haskel Gauge Isolation Debooster", 1-1977, 2 pages.

*Primary Examiner*—Stephen J. Novosad
*Attorney, Agent, or Firm*—John J. Connors; Donald R. Nyhagen

[57] ABSTRACT

This invention relates to methods and apparatus for monitoring fluid pressure in a subsea petroleum installation or other similarly inaccessible system while isolating the well fluid from the production control system. In one particular form of the invention, a body of secondary fluid is pressure-responsively coupled to but isolated from the oil or other primary fluid of interest by a piston, which subjects the secondary fluid to the pressure existing on the primary fluid. In addition, a measuring device is connected to the secondary fluid to derive an electrical signal representation of the pressure on the secondary fluid as a correlative indication of the wellhead or other pressure actually sought to be measured. Further, the isolating device is constructed and arranged to effectively seal off the primary fluid from escape into the environment or into the production control apparatus and the pressure of the primary fluid is maintained in the event of damage to any portion of the chamber enclosing and holding the secondary fluid. It is a particular feature of this invention to provide at least a minimum pressure on the secondary fluid of a magnitude such as to effectively limit the further compression of the secondary fluid by the piston, when the piston is initially subjected to the primary pressure.

39 Claims, 8 Drawing Figures

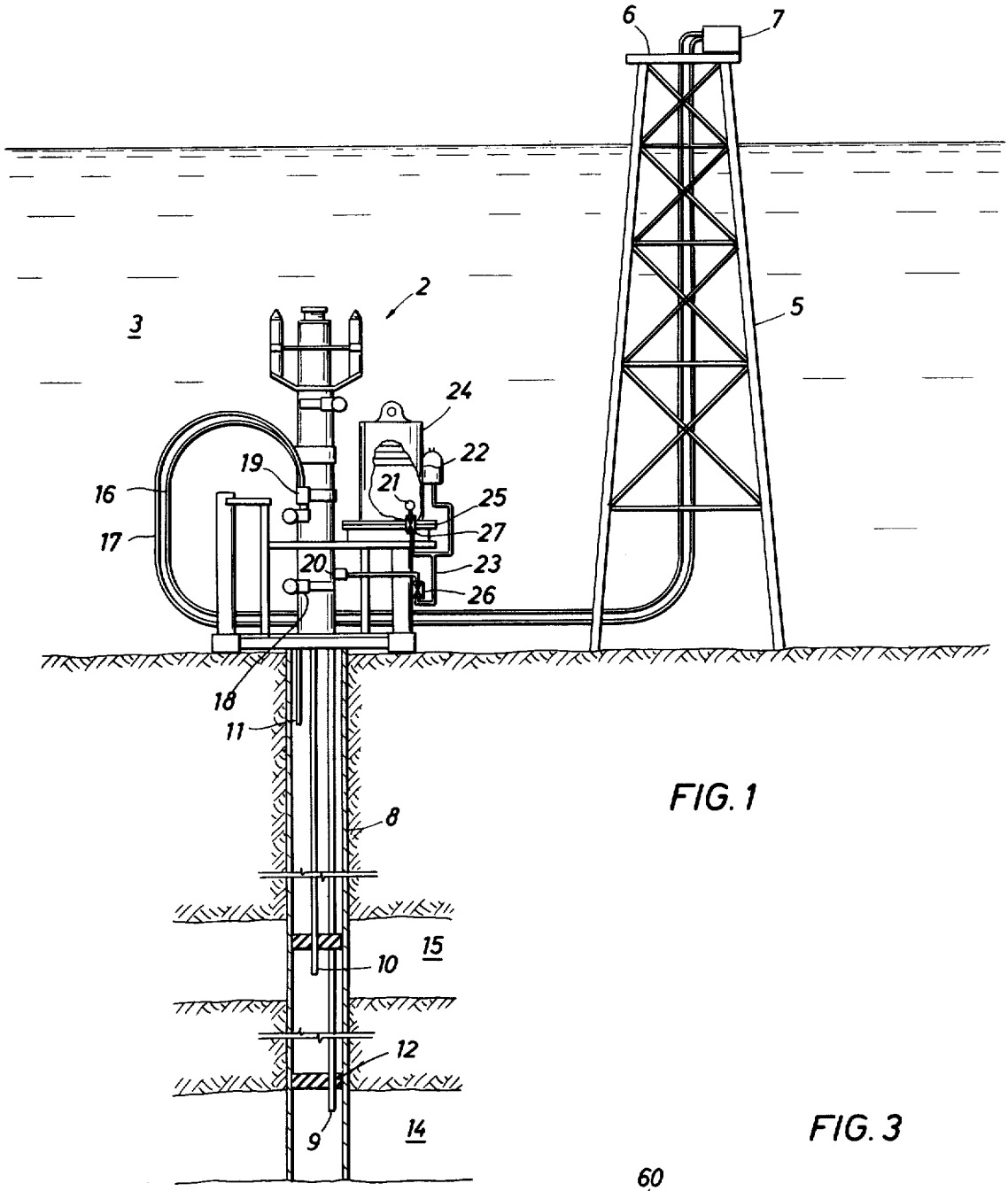
FIG. 1
FIG. 3
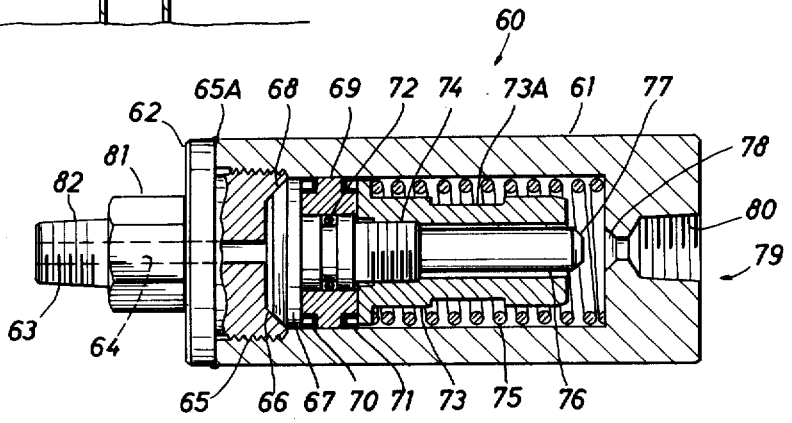

FIG. 2
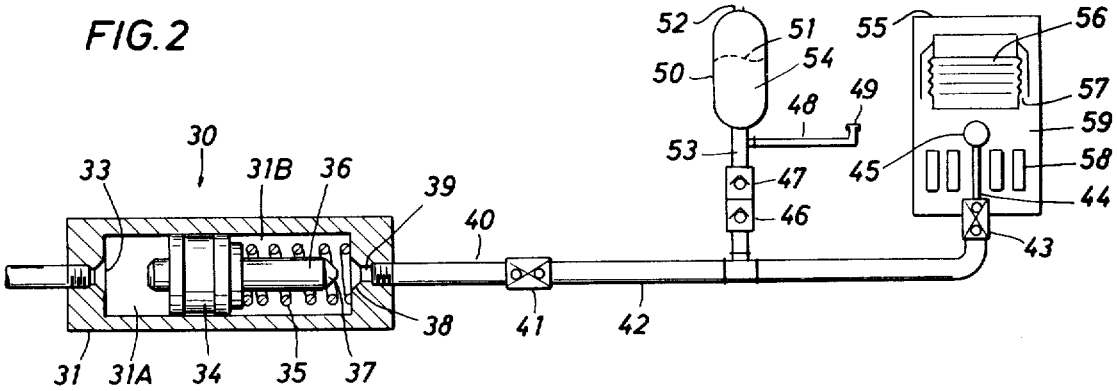
FIG. 5
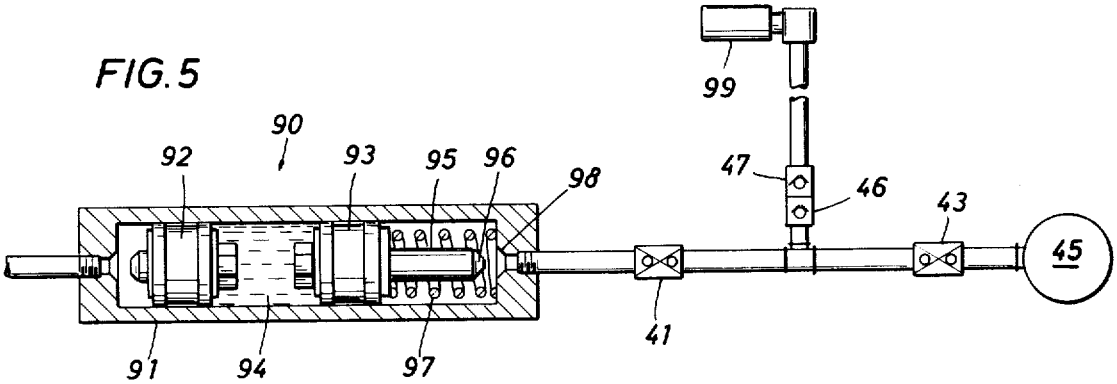
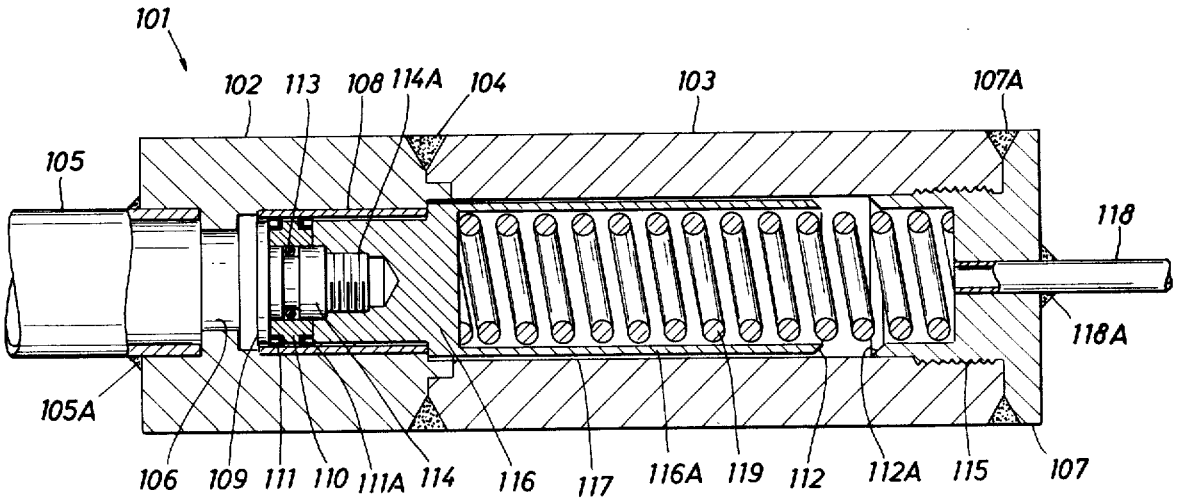
FIG. 4

FIG. 6
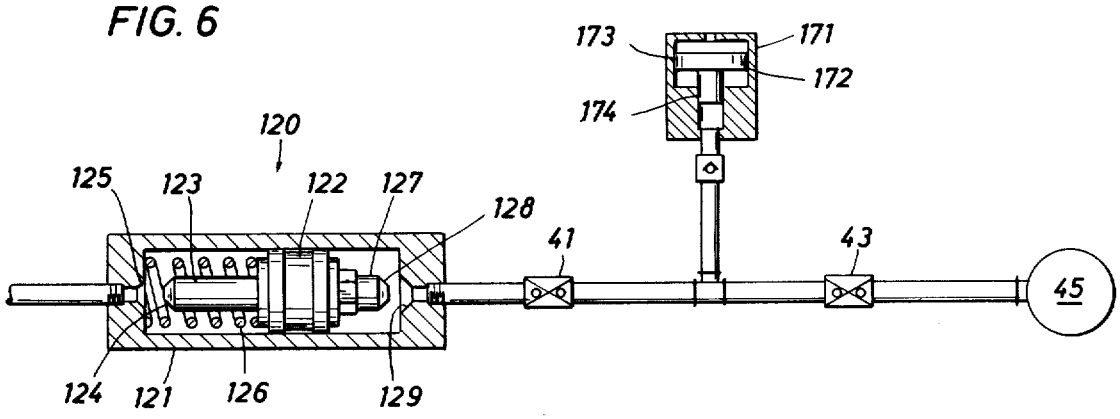
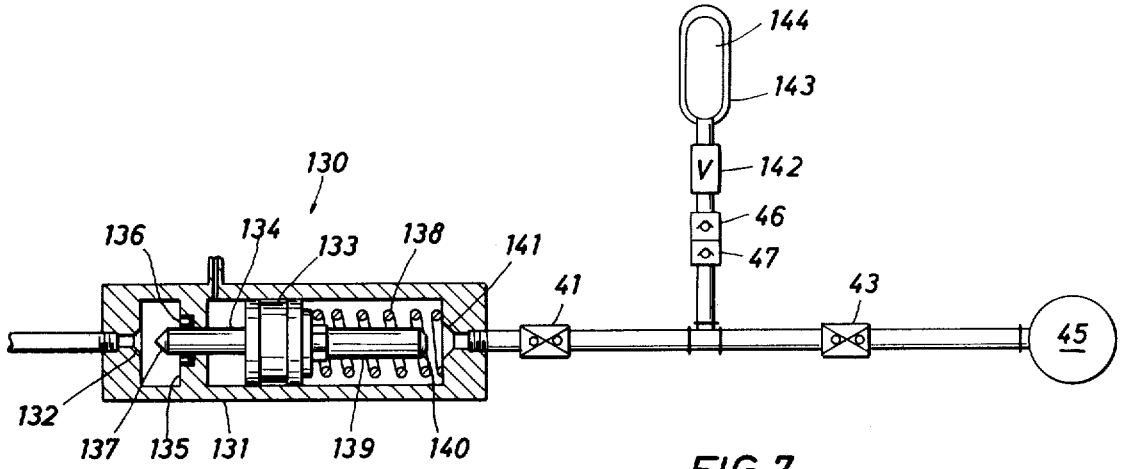
FIG. 7
FIG. 8
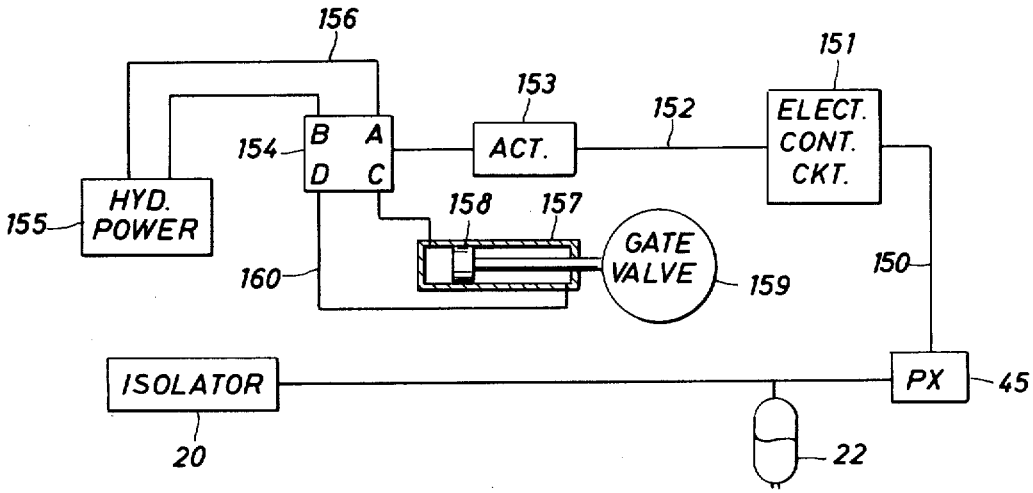

METHODS AND APPARATUS FOR SENSING WELLHEAD PRESSURE

BACKGROUND OF THE INVENTION

This invention relates to methods and apparatus for monitoring fluid pressure in relatively inaccessible locations, and more particularly relates to improved methods and apparatus for monitoring pressure in a subsea petroleum installation and the like.

It is well known that oil and gas is found in subsurface earth formations, and that wells are drilled into these formations from the surface of the earth, to recover these fluids. Moreover, it is well known that, if petroleum fluids escape from control, they tend to have a seriously damaging effect on the environment.

Any uncontrolled fluid flow from the well is always undesirable, irrespective of where the wellhead may be located, although a leak in a conventional oil well located on land is generally quite easy to detect and correct. Furthermore, enviornmental damage resulting from loss of oil on land is often limited in scope, and much of the oil may be recovered. In the case of a subsea installation, however, escape of the well fluids into the sea is environmentally more deleterious. Furthermore, a subsea discharge is much more difficult to detect, and is alsmost always more difficult and costly to correct. Also, if well fluid escapes into a subsea production control system, the well fluid may contaminate electrical components within such a system and thus damage or destroy the control system. The present invention substantially reduces the probability of such well fluid escaping, yet provides for continuous monitoring of well fluid pressure.

A petroleum installation is an active system having a variety of operating parameters such as flow rates, pressures, etc., which must be continually monitored and controlled in order to achieve maximum recovery of the oil and gas from the subsurface formations of interest. In addition, it is desirable to monitor parameters such as pressure at the wellhead and other locations in the production system as an indication of an abnormality in the petroleum recovery system, so that precautionary measures may be taken. In the case of land installations, wellhead pressure may be measured and observed by conventional gauges and the like which may be conveniently mounted on some suitable portion of the wellhead assembly to provide easily visible readings. In an offshore installation of other remote location, however, the wellhead assembly is positioned on the ocean floor and may be located deep below the surface of the water. Accordingly, the monitoring system will usually comprise a length of conduit which is connected at one end to the wellhead assembly so as to communicate with the fluid to be monitored, and which has its other end connected to a suitable pressure transducer which generates an appropriate electrical signal.

This electrical signal may be delivered to the surface by suitable electrical cables of conventional design, whereby the pressure indications can be observed and recorded, and may also be used to actuate assemblies such as gate valves and the like to control the wellhead pressure. Alternatively, the signal from the pressure transducer may be delivered to a subsea production control module, which contains electrical and hydraulic circuitry to actuate gate valves to control the wellhead pressure.

Subsea electrohydraulic control systems for continuously monitoring and controlling a number of subsea wells may be advantageously located on the sea floor at or near a wellhead. In these systems, control signals from a surface installation may be transmitted to electronic signal processing apparatus located within an enclosure at the sea floor. This apparatus commonly includes several electrically controlled valves that control the flow to hydraulic actuators located at the wellhead assemblies for actuating production flow control valves. In these systems it is desirable to monitor the pressure at various points in the production system at or near the wellhead, which may be accomplished by means of pressure transducers located within a control system enclosure. But it is also desirable that the electronic apparatus be isolated from the production flow lines which may contain corrosive well fluids.

More particularly, the pressure transducer may be mounted within the enclosure or module containing the electronic signal processing apparatus. This module may be suitably mounted on the wellhead assembly in a manner such that the control system module, including the pressure transducer, is readily removable for repair or replacement. Accordingly, the conduit which interconnects the pressure transducer with the production flow lines of the wellhead assembly, and which consequently may be several feet long, would be heretofore filled with the same well fluids which are sought to be recovered at the surface, whereby the pressure transducer is in direct contact with the well fluid and the pressure sought to be measured.

The wellhead assembly and the conduit interconnecting the interior of the wellhead to the pressure transducer are constructed to withstand high pressures, and generally will not rupture under normal design conditions. The problem, however, is that the subsea pressure measuring apparatus is often subjected to abnormal conditions which substantially increase the likelihood of inadvertent leakage. Working in a subsea environment obviously demands special equipment and, partly due to the remote location of the pressure measuring apparatus, it is possible that the conduit interconnecting the pressure transducer with the interior of the wellhead assembly may be damaged by such equipment. Also, installation or repair crews working about the subsea wellhead assembly below the surface may damage the pressure measuring apparatus, and since a well is almost always shut in whenever such work is performed, these crews will usually not realize that damage to the monitoring system has occurred until after they have returned to the surface and the wellhead control valves have been reopened.

The possibility of leakage from the connecting conduit is further increased because of the corrosive nature of the subsea environment. Under some conditions, the connecting conduit is structurally weakened by both chemical corrosion and electrochemical corrosion. Also, because the subsea pressure measuring apparatus is in a remote location, the pressure transducer normally is located within a module containing other electronic signal processing apparatus, and this module may be installed in a more accessible location farther from the interior of the wellhead than in land operations. An increased length of conduit which connects the transducer to the wellhead also increases the likelihood that leakage will occur at some point its length.

Apart from the environmental consequences of a subsea oil leak in the conduit connecting the wellhead to the pressure transducer, such a leak is also very difficult and costly to repair. Underwater repair of inherently much more difficult and expensive than repair operations on land, since qualified repair personnel and extensive equipment must be transported to the remove site. Divers not only require expensive equipment to form underwater operations, but their productivity is reduced because a substantial portion of time is required to become acclimated to the drastic change in ambient pressures. For these reasons it is desirable that subsea repairs be grouped and performed on a scheduled basis and, if possible, unanticipated repair work may be delayed until it can be accomplished at the time of scheduled repair work.

If a major leak develops the conduit connecting the wellhead to the pressure transducer, it may be readily appreciated that well fluid will pass directly to the water resulting in environmental damage and loss of recoverable oil. Further, the environmental consequences of a leak and generally much more serious than the economic loss of oil, and the well has to be shut in for a costly unscheduled repair of the leak to limit the environmental damage.

On the other hand, if there is a minor leak in the conduit connecting the wellhead to the pressure transducer, it may be appreciated that the pressure being monitored by the transducer and forwarded to automatic or manual control apparatus, may not accurately reflect the full pressure at the wellhead. Although oil recovery may be possible under such circumstances it may further be appreciated that the environmental consequences of even a minor leak may necessitate shutting in the well.

As hereinbefore explained, the consequences of a well fluid leak in a subsea oil production installation, and the difficulty and expense of correcting such a leak, is more severe than in the case of a landbased installation. Because of these disadvantages in the subsea pressure monitoring systems presently in use, and especially since governmental agencies have recently adopted regulations which are designed to severely penalize the uncontrolled release of relatively small quantities of well fluid into the environment, there is an increasing need for apparatus that will not only provide effective pressure measurements in a subsea installation, but which will further safeguard against uncontrolled discharges in the event of damage to the monitoring system. Furthermore, this need is especially severe in the case of subsurface petroleum production installations and the like, wherein even relatively minor discharges are a problem because they are not readily detected, and since even a minor leak may produce significant environmental consequences if not detected. Moreover, leaks which occur at even relatively modest depths are much more difficult and expensive to correct, in contrast with similar accidents on land, and this has further intensified the need for a better technique for monitoring wellhead pressures and the like.

As previously explained, it is advantageous that the pressure transducer be located within a module containing other electric signal processing apparatus. It may therefore be appreciated that a leak in the conduit connecting the wellhead to the pressure transducer may also subject the apparatus within the module to the deleterious well fluid. Thus, a leak at the connection between the conduit and the pressure transducer may contaminate the electronic and hydraulic control apparatus within the module with well fluid and damage or destroy that apparatus.

These disadvantages of the prior art are overcome with the present invention, however, and novel methods and apparatus are hereinafter provided for accurately monitoring wellhead and other pressures in subsea petroleum installations and other similarly inaccessible locations.

SUMMARY OF THE INVENTION

In an exemplary application of the present invention, a particularly suitable embodiment or system will include a cylindrical housing which is mounted on the wellhead assembly so as to communicate with and receive well fluids, and a piston or other suitable member which is slidably mounted within the housing to divide its interior into a primary pressure chamber receiving the oil or well fluid, and a secondary pressure chamber having its own separate outlet port in the other end of the housing. A conduit or tubing member is connected to the outlet port of the secondary pressure chamber within the housing, with its other end connected to a remotely located pressure transducer or other suitable device for providing an indication of fluid pressure. Ordinarily, it is preferred to locate the pressure transducer inside an electrohydraulic control module that contains electronic signal processing apparatus and is filled with a high dielectric mineral oil to protect the electronic apparatus within the module.

Both the conduit and secondary pressure chamber are preferably pre-filled with hydraulic oil or other suitable liquid so that, when the primary pressure chamber in the housing is opened to the well fluids under the wellhead pressure sought to be monitored, this primary or wellhead pressure will drive the piston slidably towards the outlet port in the housing until the pressure within the secondary pressure chamber equals the primary pressure.

As hereinbefore stated, the signal or indication provided by the pressure transducer is actually derived from the pressure applied to the fluid in the secondary chamber by the piston. Since the piston establishes this secondary pressure at a level equal to the wellhead pressure, however, it will be apparent that the measurement being derived from the pressure in the secondary chamber will correspond to the primary or wellhead pressure measurement sought to be monitored.

If the fluid in the secondary pressure chamber is relatively incompressible, the piston will experience relatively little movement within the housing when the primary chamber is subjected to the well fluid. The fluid in the secondary chamber may include some air, however, no matter how carefully the secondary chamber may be pre-filled with liquid. Accordingly, the air in the secondary chamber will be highly compressible in contrast with the liquid portion of the fluid, and it is this degree of compressibility of the air component which accounts for most of the movement of the piston. Furthermore, the extent of such piston movement will be directly related to the magnitude of this compressibility factor, as will hereinafter be explained in greater detail.

As will also hereinafter be more clearly explained, it is a feature of the instant invention that the piston act to seal off the wellhead, in the event of a leak in the secondary fluid system, in order to prevent any escape or discharge of well fluids through the housing and into the environment. Accordingly, the piston is preferably adapted to engage a sealing surface about the outlet port in the housing, if it is driven the full distance within the housing, and to thereby seal off the interior of the housing in the event of an abnormal pressure drop in the secondary pressure chamber. Since this effectively creates a limit on the distance which the piston can travel within the housing, it is desirable to minimize the the compressibility of the secondary fluid by the piston moving within the housing, whereby compression of the secondary fluid does not permit the piston to engage the outlet port before the secondary fluid is fully pressurized.

It is a well-known characteristic of the compressibility of a fluid, of course, that most of the reduction in its volume will occur as the fluid is compressed through the range of lower pressures, and that further compression under higher pressures will consequently achieve relatively smaller reductions in fluid volume, especially when the fluid being compressed is largely gaseous in character. Thus, it is a feature of the present invention to pre-pressurize the fluid in the secondary chamber to an extent that most of the reduction in the volume of the secondary fluid occurs before the primary chamber in the housing is opened or connected to receive the wellhead fluids. This, in turn, reduces or minimizes the distance which the piston travels when the primary chamber is first subjected to the wellhead or primary pressure sought to be monitored, and thus the piston is prevented from reaching its full travel limit and sealing off the outlet port in the housing, unless there is an inadvertent leak in the secondary fluid system.

This pre-pressurizing of the secondary fluid may be conveniently effected in various ways, depending upon particular circumstances or application of the invention. In the case of a typical subsea petroleum installation, where the wellhead assembly and the housing and piston may be located at a depth of 450 feet or more below the surface of the water, a secondary fluid reservoir or accumulator may be connected to the conduit to apply a pre-pressure on the secondary fluid equal to the ambient water pressure at that depth. This in turn, will effectively pressurize the secondary fluid whereby its gas component will experience approximately 90% of its shrinkage, and whereby travel of the piston will be effectively reduced or minimized to an extent that, even if the primary pressure is many times greater than the ambient pressure at the wellhead, the piston does not travel its full limit and prematurely shut off the housing before the secondary fluid becomes fully pressurized. On the other hand, it will also be apparent that, if a leak develops in any portion of the secondary pressure chamber, the piston will move to its full limit to shut off the outlet port in the housing, and to thereby prevent any escape or uncontrolled discharge of well fluids into the environment.

Accordingly, it is a feature of the present invention to provide improved methods and apparatus for remotely monitoring the pressure on a fluid which is deleterious to the environment.

It is also a feature of the present invention to provide improved pressure monitoring methods and apparatus including provision for preventing escape of the pressurized fluid into the environment.

It is a feature of this invention to provide improved methods and apparatus for remotely monitoring the tubing pressure in a subsea petroleum production installation.

It is also a feature of this invention to provide isolation means which provides a barrier between a primary fluid and a secondary fluid, wherein the secondary fluid pressure is a function of the primary fluid pressure, and a pressure transducer is responsive to the secondary fluid pressure.

Another feature of this invention is to provide sealing means within the isolator means whereby a leak in the secondary fluid system will result in a seal between the primary fluid and the surrounding environment.

Another feature of this invention is to provide an electrohydraulic production control apparatus wherein pressure transducers are located within a subsea module that also contains electronic apparatus, with the pressure transducers being operatively coupled to hydraulic fluid lines which are operatively connected to pressure isolation devices located outside the electrohydraulic control module and, preferably, closely adjacent the production flow lines or wellhead components whose pressure is to be monitored.

A particular feature of this invention is to provide apparatus for monitoring a primary pressure comprising a secondary fluid chamber adapted to contain a secondary fluid, isolator means disposed between a petroleum fluid and said secondary fluid for establishing a secondary pressure in said secondary fluid chamber at a level functionally related to said primary pressure, pressure transducing means interconnected with said pressure chamber for deriving an indication of said secondary pressure, and pressurizing means responsive to said secondary pressure for subjecting said secondary fluid to an initial pressure of a magnitude functionally related to the ambient subsea pressure.

Still another particular feature of this invention is to provide a method of monitoring and controlling a primary pressure in a subsea system containing a primary fluid, comprising establishing a second fluid isolated from said primary fluid by a yieldable barrier therebetween, establishing and maintaining an initial pressure on said secondary fluid substantially reducing the further compressibility of said secondary fluid, thereafter applying said primary pressure to said yieldable barrier for increasing the pressure on said secondary fluid in a manner functionally related to said primary pressure, deriving an indication of the pressure on said secondary fluid as a function of said primary pressure in said system, and controlling said primary pressure in response to said indication of the pressure on said secondary fluid.

A further particular feature of this invention is to provide apparatus for monitoring the pressure on a primary fluid, comprising a control module including control circuitry immersed in a protective fluid, pressure transducing means for sensing the pressure of a sensor fluid, means for generating an electrical signal representation of said pressure of said secondary fluid and transmitting said signal to said control circuitry, isolation means coupled between said primary fluid and said secondary fluid for subjecting said secondary fluid to a pressure functionally related to said pressure on said primary fluid, shutoff means for retaining said primary fluid within said production installation in the event of a leak in said secondary fluid chamber, and means reponsive to said control circuitry for varying selected operating parameters of a subsea petroleum production installation.

These and other features and advantages of this invention will become apparent in the following detailed description, wherein reference is made to the figures in the accompanying drawings.

Drawings

FIG. 1 is a simplified pictorial representation of a subsea oil well installation during an exemplary embodiment of the invention.

FIG. 2 is a simplified functional representation of a portion of the apparatus depicted in FIG. 1.

FIG. 3 is a detailed pictorial representation, partly in cross-section, of a portion of the apparatus generally illustrated in FIGS. 1 and 2.

FIG. 4 is a detailed pictorial representation, partly in cross-section, of an alternate embodiment of the apparatus depicted in FIG. 3.

FIG. 5 is a simplified functional representation of an alternate embodiment of the apparatus generally depicted in FIG. 2 and more particularly illustrated in FIGS. 3 and 4.

FIG. 6 is a simplified functional representation of another form of the apparatus generally depicted in FIGS. 2 and 5.

FIG. 7 is a simplified functional representation of an alternate form of the apparatus generally depicted in FIGS. 2, 5 and 6.

FIG. 8 is a simplified functional representation of apparatus embodying a form of the present invention and particularly suitable for use with a subsea petroleum imstallation of the type suggested in FIG. 1.

DETAILED DESCRIPTION

FIG. 1 illustrates a simplified pictorial representation of a typical subsea petroleum installation including a wellhead assembly 2 positioned at the floor of the ocean 3 or other body of water, and further superposed over the mouth of a typical borehole 4. More particularly, the borehole 4 may be seen to contain a casing 8 extending along substantially its entire length and transversing at least an upper subsurface formation 15 of interest, and a lower formation 14 of similar character. In addition, a section of tubing 11 extends from the bottom of the wellhead assembly 2 and into the casing 8, a second tubing 10 extends further below the wellhead assembly 2 and through an upper packer 13 to communicate with the upper formation 15, and finally a longer string of tubing 9 extends through both the upper packer 13 and a lower packer 12 to communicate with the lower formation 14.

Referring again to FIG. 1, the casing 8 will conventionally be provided with perforations (not depicted) adjacent the upper formation 15, whereby oil or other well fluid may enter the casing 8 from the formation 15 and thereafter move through the tubing 10 to the wellhead assembly 2. Similarly, the casing 8 may also be provided with such perforations adjacent the lower formation 14, whereby oil may travel from the formation 14 into the casing 8 and thence into the tubing 9 for delivery to the wellhead assembly 2. In this respect, it will be seen that the lower packer 12 is positioned to prevent the oil from the lower formation 14 from entering either tubing 10 or tubing 11, and the upper packer 13 and lower packer 12 will restrict oil from the upper formation 16 to only the tubing 10. The purpose of the third tubing 11 is to communicate with the interior of the casing 8, and to provide means for determining the pressure in the casing. If the pressure in casing 8 increases beyond an acceptable limit, the casing 8 may be vented to relieve the excessive pressure, or, if it is determined that a catostrophic blow-out is imminent, signals may be transmitted to the wellhead assembly 2 for closing safety valves or actuating other protective devices.

Referring again to FIG. 1, there may be seen a flow line 16 which extends from the wellhead assembly 2 to the platform portion 6 of a representative tower 5, and to the transition recovery tank 7 which is conventionally located on the platform 6. It may be appreciated that the tower 5 may be centrally located for use in conjunction with many wells, and that wellhead assembly 2 may be located a substantial distance from the tower 5. Accordingly, flow lines 16 and 17 will be provided to transfer oil from the wellhead assembly 2 to the tank and other equipment 7 on the platform 6. For these purposes, flow line 16 may be assumed to be in fluid communication with tubing 9 and flow line 17 may be assumed to be connected to tubing 10. The flow of oil from tubing 9 to flow line 16 is controlled by valves 18 and 19. Similar valves (not specifically depicted) will conventionally be provided to control the flow of oil from tubing 10 to flow line 17.

Referring again to FIG. 1, the wellhead assembly further includes a simplified functional representation of an isolator 20 as will hereinafter be described, a flow line or conduit 23 extending from the isolator 20 to a suitable pressure transducer 21 and a secondary fluid reservoir or accumulator 22. As will hereinafter be explained, the function of the pressure transducer 21 is to provide an indication of the pressure within a selected one of the strings of tubing 9–11, at the level of the isolator 20. The function of the secondary fluid reservoir or accumulator 22 is to initially apply a pressure to fluid within the conduit 23, wherein the pressure applied may be equal to the ambient pressure at that depth within the ocean or water 3.

As seen in FIG. 1, the pressure transducer 21 is located within a production control module 24. Module 24 forms a fluid-tight enclosure around the pressure transducer 21 and other electronic and hydraulic apparatus within the module. The module 24 may be mounted on any suitable structural support of the wellhead assembly 2 by means of a typical module flange 25. The conduit 23 contains quick disconnect couplers 26 and 27 which allow removal of the module 24, including transducer 21, from the wellhead assembly 2. This permits repair or replacement of the control system module without interrupting production from the wellhead assembly 2.

As will hereinafter be explained, one of the functions of the isolator 20 is to transmit pressure to a fluid in the conduit 23 which corresponds to the wellhead pressure in the selected ones of tubings 9–11. Accordingly, the indication which is provided by the pressure transducer 21, and which may be relayed to the surface by appropriate electrical conductors (not shown), will correspond to the pressure within the selected one of tubings 9–11.

It should be noted that the isolator 20 will connect with only one of the tubings 9–11. Accordingly, if a measurement of the pressures in the other two tubing strings is desired, then a separate measurement or monitoring system will be provided for each of the three tubings 9–11. Thus, it may be assumed for present purposes that the measurement which the pressure transducer 21 derives from the isolator 20 will correspond to only the wellhead pressure on the fluid in tubing 9, and that a measurement of the pressures in tubings 10 and 11 will be provided by other isolators and pressure transducers (not depicted).

Referring now to FIG. 2, there may be seen a simplified functional representation of the embodiment of the present invention depicted in FIG. 1, including an isolator 30 which corresponds to isolator 20 depicted in FIG. 1, a pressure transducer 45 and a secondary fluid reservoir 50. Isolator 30 comprises a cylinder 31, a piston 34, a shaft 36 and a spring 35. Cylinder 31 has an inlet port 33 at one end and an outlet port 39 at the other end. The piston 34 is slidably movable within the cylinder 31 and divides the interior of the cylinder 31 into a primary pressure chamber 31A and a secondary pressure chamber 31B. The spring 35 acts against the piston 34 to properly position the piston 34 within the isolator 30 when the pressures within the primary chamber 31A and secondary chamber 31B are approximately equal. Attached to the piston 34 is the shaft 36 having a shut-off end 37 designed to seal with a seat 38 should the piston 34 move far enough within the cylinder 31 toward the outlet port 39.

Attached to the outlet port 39 is a nipple 40, which is further attached to a conduit 42 by means of a quick disconnect coupler 41. The other end of the conduit 42 is likewise attached to nipple 44 through a quick disconnect coupler 43. The representative pressure transducer 45 is connected to the nipple 44, and thus it may be seen that the pressure transducer 45 is in fluid communication with the secondary pressure chamber 31B.

As seen in FIG. 2, the pressure transducer 45 is located within a production control module 55, which corresponds to the module 24 in FIG. 1. The production control module 55 may contain electrically actuated hydraulic control valves 58, which, in turn, may control the hydraulic pressure which regulates the operation of various production control devices such as valves 18 and 19 in FIG. 1.

The production control module 55 may be filled with a suitable dielectric fluid 59 to protect the apparatus within the module 55. Also, electronic apparatus 56 within the module 55 may be further protected by enclosure 57 which may be filled with another dielectric fluid. The production control module 55 preferably is joined to the conduit 42 by means of the quick disconnect coupler 43, which enables the production control module 55 including the pressure transducer 45 to be easily removed from and returned to the wellhead assembly. Production control module 55 may be pressure balanced with the subsea, and may be of the type more fully described in pending U.S. Patent Application Ser. No. 883,369 filed Mar. 6, 1978 entitled "Pressure Balanced Subsea Enclosure and Electronic Components".

Pipe 53 is connected at one end to the conduit 42 and at the other end to the secondary fluid reservoir 50. The secondary fluid reservoir 50 has a port 52, which is open to the sea water pressure, and a diaphragm 51 that isolates the secondary fluid reservoir chamber 54 from the sea water. Pipe 53 is shown to include check valves 46 and 47 which allow fluid flow from the secondary fluid reservoir 50 into the conduit 42, but prohibit fluid from flowing in the reverse direction. A fill pipe 48 and a cap 49 are attached to pipe 53, whereby the secondary fluid chamber (comprising of the secondary pressure chamber 31B, nipple 40, conduit 42 and nipple 44), pipe 53, fill pipe 48 and secondary fluid reservoir chamber 54 may be filled with a suitable fluid. Check valves 46 and 47 allow the pressure in the secondary fluid chamber to increase in response to an increased pressure in the secondary fluid reservoir chamber 54, but seal the secondary fluid chamber from the secondary fluid reservoir chamber 54 when the pressure in the secondary fluid chamber is greater than the pressure in the secondary fluid reservoir chamber 54.

FIG. 3 illustrates in more detail a particularly suitable form of apparatus which corresponds to isolator 30 depicted in FIG. 2, and which will hereinafter be referred to as an isolator 60. The isolator 60 includes a cylindrical housing 61 having an end cap 62 mechanically attached by threads 65 and sealed in a fluid-tight manner by a weld bead 65A. A nut 81 having an end portion 82 may be welded or otherwise suitably fixed to the end cap 62, whereby the isolator 60 may be conveniently affixed in a fluid-tight manner to the wellhead assembly 2 by means of threads 63. A passage 64 is provided through the nut 81 and end cap 62, whereby fluids may enter from tubing 9 and whereby the piston head 67 may be subjected to the primary fluid pressure sought to be monitored. The piston assembly in the housing 61 comprises the piston head 67, a shaft portion 76, a piston nut 73, and a sleeve 69. The piston head 67 may also suitably have a shut-off end portion 68 which is designed to engage a seat portion 66 formed in the end cap 62 for the purpose of trapping fluid within the housing 61. The shaft 76 is provided with a shut-off end portion 77 which is also preferably designed to engage in a fluid-tight manner with seat portion 78 formed in the cylinder housing 61. The piston nut 73 may have a hex portion 73A by which the piston nut 73 may conveniently be secured to the shaft 76 by threads 74 by means of a wrench (not depicted). The sleeve 69 is preferably located between the piston head 67 and the piston nut 73, and is also preferably provided with two high pressure dynamic seals 70 and 71, such as high pressure U-cup seals, to prevent commingling of the primary fluid with the secondary fluid while the piston head 67 travels slidably within the cylinder housing 61. An appropriate static seal 72 preferably is included to prevent fluid from passing between the sleeve 69 and the shaft 76. Spring 75 is preferably included to act against the piston nut 73 to properly position the piston assembly within the cylinder housing 61, whereby the shutoff portion 77 does not engage the seat 78 during normal operation of the pressure sensing system, but does engage the seat 78 and provide a fail-safe closure of housing 61 if the secondary fluid chamber is ruptured. The cylinder housing 61 is preferably provided with an exit port 79 having threads 80 for convenient interconnection with the nipple 40 shown in FIG. 2.

FIG. 4 illustrates an alternate embodiment of the isolator depicted in FIG. 3. The isolator assembly 101 has a cylindrical outer housing 102 and an outer housing 103 which are joined by a weld bead 104. The end of the outer housing 102 has a passage 106 therein, whereby fluid may enter from the tubing 9 and whereby the head portion 109 of the piston assembly 114 may be subjected to the primary pressure sought to be monitored. A pipe 105 is attached to the end of the housing 102 by a fluid-tight weld 105A, and it is to be understood that the pipe 105 is in fluid communication with the tubing 9.

The piston assembly 114 includes a head portion 109 and a shaft 116 which is connected to the head portion 109 by threads 114A. The shaft 116 includes sleeve portion 116A, and the spring 119 rests within the sleeve portion 116A.

As in the isolator assembly depicted in FIG. 3, the isolator assembly 101 also includes two high pressure dynamic seals 111 and 111A, to seal the primary fluid from the secondary fluid, and a static seal 113 to prevent fluids from passing between the sleeve 110 and the head portion 109.

The head portion 109 of the piston assembly 114 is prevented from sealing with the outer housing 102 at the location of the passage 106 since the shaft 116 will first engage the outer housing 102, as shown in FIG. 4. Thus, the head portion 109 of the piston assembly 114 is fully subjected to the pressure of the primary fluid, and is not limited by the size of the passage 106. This arrangement may better enable the piston assembly 114 to move in response to the primary pressure, since the entire area of the head portion 109 is always subjected to the primary pressure.

A liner 108 is included in the outer housing 102. The liner 108 is long enough to allow the seals 111 and 111A to sealingly engage the liner during the maximum stroke of the piston assembly 114. A slight clearance may be provided between the sleeve portion 116A of the piston assembly 114 and the inner surface 117 of the outer housing 103. Since the sleeve portion does not contact the surface 117, there is no friction between the piston assembly 114 and the outer housing 103.

At its right-hand end, the sleeve portion 116A has a shut-off portion 112 designed to sealingly engage seat 112A if the piston assembly 114 moved to the rightmost position within the isolator assembly 101.

The isolator assembly 101 is shown to include an end cap 107 which may be attached to the outer housing 103 by threads 115 and joined in a fluid-tight manner by a weld bead 107A. A nipple 118 which corresponds to the nipple 40 shown in FIG. 2, may be attached to the end cap by weld bead 118A.

Referring now to FIG. 5, there may be seen a functional representation of an alternate embodiment of the apparatus depicted in FIGS. 2 and 3. More particularly, a different isolator 90 is provided which has a first piston 92 and a second piston 93 slidably located within a cylinder 91, and separated by a space which is conveniently filled with a suitable liquid 94 to maintain a separation between the first piston 92 and the second piston 93. The second piston 93 is preferably provided with a shaft 95 having a shut-off end 96 to mate with a seat portion 98 in the cylinder 91 upon sufficient movement of the second piston 93 to the right. A spring 97 may conveniently be provided to oppose such movement of the second piston 93, and also to properly position both the first piston 92 and the second piston 93 within the cylinder 91, to prevent premature shut-off as hereinbefore described. In FIG. 5, it may be seen that a pump 99 may be substituted for secondary fluid reservoir 50 shown in FIG. 2, for filling and pressurizing the secondary fluid system to a preselected or predetermined pressure level prior to applying of the tubing or primary pressure to the isolator assembly 90.

Referring now to FIG. 6, there may be seen another simplified functional representation of an alternate embodiment of the apparatus depicted in FIG. 2, wherein an isolator assembly 120 is provided with a piston 122 which is slidably movable within a cylinder 121, but wherein the piston has a left-end shaft 123 with a suitable shut-off end 124 to mate with seat 125, and a right-end shaft 127 with a suitable shut-off end 128 for fluid-tight engagement with a suitable seat 129. A spring 126 is provided to oppose movement of the piston 122 in response to secondary pressure, in order to properly position the piston 122 within the cylinder 121 before the system is placed in operational status, as will be further explained below.

In FIG. 6, the secondary fluid reservoir 171 is provided which employs a slidable piston 172 to transmit the subsea pressure to the secondary fluid chamber. The piston 172 may be constructed to have a head portion 173 exposed to the sea water, and a stem portion 174 in contact with the secondary fluid. The head portion 173 may be of the same or less cross-sectional area as the stem portion 174. Alternatively, head portion 173 may be greater than the stem portion 174, as shown in FIG. 6, to provide a secondary fluid pressure greater than the ambient sea pressure, as more fully explained below.

In FIG. 7, there is shown another isolator assembly 130 having a piston 133 which is also slidably movable within a housing 131, and wherein the piston 133 has a left-end shaft 134 with a shut-off end 137 to engage with seat 132, and wherein the piston 133 also has a right-end shaft 139 having a shut-off end 140 for engaging seat 141. A spring 138 acts against the piston 133 substantially in a manner previously described. The left-end shaft 134 will also be seen to be slidably movable through a wall portion 135 having a high pressure seal 136 to prevent the primary fluid from reaching the body or head portion of the piston 133 as will hereinafter be explained in detail.

Also shown in FIG. 7 is a suitable accumulator 143 which may be employed as a secondary fluid reservoir. The accumulator 143 may be a sealed outer chamber containing a gas under high pressure and further housing an expandable inner container 144 which holds a liquid under a similar high pressure. Upon opening a valve 142, a portion of the liquid in the expandable inner container 144 may pass to the secondary fluid chamber, and as the gas in the sealed outer chamber expands to expel further fluid from the inner chamber 144, the secondary fluid is suitably pressurized.

Referring now to FIG. 8, there may be seen a simplified functional representation of a control system suitable for use with a subsea petroleum installation of the type generally depicted in FIG. 1, and further embodying and employing a suitable form of the present invention. As hereinbefore explained, it is the object of this type of pressure monitoring system to provide a continuous indication of the tubing or casing pressures at the wellhead, and more desirably to provide such indications in the form of electrical signals which may be employed for various purposes. Accordingly, the pressure transducer 45 may conveniently be a piezoelectric or magnetostrictive device for generating a suitable electric signal 150 which is transmitted by appropriate means to suitable electric control circuitry 151.

The electric control circuitry 151, may include provision for receiving and handling various other electrical indications of significant operating parameters. For example, failsafe logic circuits may be included for not only receiving and handling electrical indications of loss of hydraulic power, loss of AC electrical power within or to the circuitry 151, abnormally low DC electric power also within or to the circuitry 151, abnormal pressures within system or flow lines such as conduits 16 and 17, detection of escaped oil by a hydrocarbon sensor (not depicted) on the wellhead assembly 2, and also command signals (not depicted) from the platform 6, but also to generate one or more command or actuating signals in response to appropriate input signals or combinations of such input signals.

Referring again to FIG. 8, therefore, it may be seen that if the signal 150 is indicative of an abnormal pressure rise in the secondary fluid portion of the isolator 20, the control circuitry 151 responds either manually or automatically to generate an appropriate actuating or command signal 152 to shut down or reduce production from the appropriate one of the two subsurface earth formations 14 and 15. More particularly, the command signal 152 may conveniently be applied to the motor or solenoid actuator 153 of an appropriate control valve 154 which, in turn, is connected in the supply line 156 extending from a suitable hydraulic power source 155 to the input side or port of a hydraulic cylinder 157. The rod of the piston 158 will, in turn, be extended to totally or partially close the appropriate gate valve 159, such as valve 19 depicted in FIG. 1. Alternately, the signal 150 may also be used to actuate various operational apparatus (not depicted) within the petroleum production installation.

It will be noted that when port A is open to port C and port B is open to port D, the hydraulic power will drive the piston 158 to close the gate valve 159, but when port A is open to port D and port B is open to port C, the piston 158 will retract to open the gate valve 159. It may also be noted that the actuator 153 may be conveniently biased in the A–C and B–D position, so that the gate valve 159 will close thus shutting in the well, should the command signal 152 fail to reach the actuator 153. As seen in FIG. 8 the gate valve 159 is normally held open since valve 154 is normally held in A–D and B–C position by the actuator 153 in response to the command signal 152.

As hereinbefore explained, the control circuitry 151 may be located at some remote site where it may be conveniently monitored and used in conjunction with other system components, or it may be conventionally packaged and incorporated into the wellhead assembly 2 on the floor of the ocean 3. Accordingly, command signal 152 may be generated by suitable logic circuitry 151, or it may be generated manually and selectively on the basis of visual observation of other operating parameters, or merely to shut in production for other unrelated reasons.

As previously stated, the pressure transducer 45 preferrably is located in a production control module, such as module 55 depicted in FIG. 2. Also, the electronic circuitry 151 and the control valve 154 may be enclosed within the production control module 55, in which case the electronic circuitry 151 would correspond with the electronic apparatus 56 and the control valve 154 would correspond with one of the electrically actuated hydraulic control valve 58 depicted in FIG. 2. One of the advantages in the system described above is that all the electronic apparatus, including the pressure transducer 45, is conveniently contained within the module 55. Thus, only hydraulic circuitry is required outside the module 55 to control the production of the subsea petroleum recovery system. Further, by disengaging module 55 at flange 25 (FIG. 1), the entire electronic apparatus may be removed to the surface for repair or replacement without disturbing the wellhead assembly or production flow lines and without risk of leaking well fluids into the sea.

In any case, it should be noted that the components and functions which are suggested and depicted in FIG. 8 combine to monitor and utilize an indication of subsea tubing pressure in a manner entirely suitable to the objects and features of the present invention.

Returning now to FIG. 2, it may be noted that the apparatus depicted therein will conventionally be installed on the wellhead assembly 2 at the time the wellhead assembly 2 is initially prepared for installation on the top of the borehole 4. At that time, a suitable liquid such as hydraulic oil and the like will be desirably introduced through fill pipe 48 to the interiors of the pipe 53 and the secondary fluid reservoir 54 of the secondary fluid reservoir 50. The liquid will also pass check valves 46 and 47 and fill the secondary fluid chamber, consisting of the conduit 42, the nipples 40 and 44, and the interior portion of the cylinder 31 between the piston 34 and the port 39 therein. The combined space, of the secondary fluid chamber and the fill pipe 48, pipe 53 and the secondary fluid reservoir chamber 54, may be purged of air to a maximum extent. However, some air will usually be trapped in the secondary fluid chamber during this filling operation, and this air component of the fluid will inherently tend to enhance the compressibility of the mixture as will hereinafter be explained in greater detail.

Referring again to FIG. 2, it will be noted that the function of the secondary fluid reservoir 50 is to apply a pressure on the fluid mixture in the secondary fluid chamber which is functionally related to the ambient pressure on the overall system. A yieldable barrier means such as piston 34 is movable in the cylinder 31, but it also tends to provide a fluid-tight seal therein. Accordingly, when the wellhead assembly 2 is subsequently lowered to the floor of the ocean 3, pressure on the fluid in the secondary fluid chamber will increase as a function of subsea pressure on the diaphragm 51 in the secondary fluid reservoir 50, and this increase in pressure will be registered by the pressure transducer 45.

It will be noted that the apparatus depicted in FIG. 2 includes at least one and preferably two check valves 46–47, which are provided to prevent escape of the secondary fluid in the event of a leak in the system between valve 47 and the diaphragm 51. However, these check valves 46–47 also prevent the loss of the secondary pressure after the piston 34 is positioned to the left within the cylinder 31. Also, these check valves function to prevent loss of pressure on the secondary fluid, once the system is placed in operation. It will be noted that check valves 46 and 47 not only prohibit leakage of fluid from the conduit 42 into the secondary fluid reservoir chamber 54, they also prevent risk of rupture to the diaphragm 51 when the secondary pressure rises to levels corresponding to the primary pressure. Although only one check valve is actually necessary to provide these advantages, two check valves 46 and 47 are preferably provided as an extra precaution in case one check valve leaks.

Referring again to the isolator 30, it will be noted that a biasing means such as spring 35 functions to normally hold the piston 34 at its leftmost position even before the wellhead assembly 2 has been lowered into the ocean. Accordingly, when the secondary pressure rises as a result of the wellhead assembly 2 being lowered to the floor of the ocean 3, as hereinbefore described, the secondary fluid is compressed and supplemental fluid is added to the conduit 42 of the secondary fluid chamber by passing from the secondary fluid reservoir chamber 54 through the check valves 46 and 47. Moreover, the extent of such contraction will largely be due to the greater compressibility of the air component of the fluid mixture, rather than to its oil or liquid component which is relatively incompressible by normal standards.

The spring member 35 is preferably arranged in the isolator assembly 30 so that when the piston is in the leftmost position just prior to being subjected to the primary pressure, a minimum amount of longitudinal compression is exerted on the piston 34 by the spring member 35. Since the spring force may therefore be assumed to be negligible at this time, the pressure transducer 45 will generate a pressure reading which will correspond to the ambient subsea pressure when the wellhead assembly 2 is installed on the floor of the ocean 3.

If the gate valve 159 (functionally similar to valve 18 in FIG. 1), is now opened as hereinbefore described, tubing or primary pressure will now enter the cylinder 31 through the intake port 33, and if this pressure in the primary chamber 31A rises to a level greater than the sum of the force on the spring 35, the friction between the piston 34 and the cylinder 31, and also the secondary pressure, the piston 34 will tend to shift away from the intake port 33 until the secondary pressure either reaches the level of the primary pressure, or else the piston 34 drives so far that the shut-off portion 37 of the piston shaft 36 moves into fluid-tight engagement with the seat portion 38 of the outlet port 39. If this latter alternative occurs, the pressure in conduit 42 will rise no farther notwithstanding further increases in the primary pressure. Accordingly, it will be seen that this feature provides an effective safeguard against escape or uncontrolled release of well fluids into the environment, in the event of leakage in or damage to any of the components defining the secondary fluid chamber.

Referring again to the apparatus in FIG. 2, it should be noted that piston 34 acts as the principal pressurizing means on the secondary fluid, once the piston 34 has been dislodged from the intake port 33 by the primary pressure, and thus the reading which is provided by the pressure transducer 45 with respect to the secondary fluid pressure will be functionally correlative to the primary pressure being applied to the piston 34. The pressure transducer 45 measures only the pressure on the secondary fluid, however, and thus the reading provided by the pressure transducer 45 will inherently be subject to error factors corresponding to the friction of the piston 34, and the resistance of the spring 35.

The magnitude of the error resulting from friction of the piston 34 can be reduced by proper design, although the need to provide a fluid-tight seal across the piston 34 will inherently produce a minimum error factor in the measurement. With respect to the spring factor, however, this error component is most effectively minimized by providing for a minimum distance of piston travel within the cylinder 31. Not only does the spring 35 create an error factor in the measurement, it will be apparent that this error increases as a function of the distance which the piston 34 travels within the cylinder 31 after being subjected to wellhead pressure.

The piston 34 is capable of travel only within predetermined limits based on the particular design of the isolator assembly 30. The extend of piston travel is, of course, directly related to the extent that the secondary fluid is compressed or constricted when wellhead pressure is introduced to the piston 34 in the isolator 30. Accordingly, if the secondary fluid is pre-pressured to an extent such that it will experience only a small degree of further compression when the piston 34 is subjected to wellhead pressure, this will effectively reduce or minimize the error which is introduced into the measurement by compression of the spring 35 in the isolator 50. It may therefore be desirable to pressurize the secondary fluid to a level which will limit the travel of the piston 34 when subjected to wellhead pressure. Further, the secondary fluid may be pressurized to a level which effectively limits the amount of further compressibility of the secondary fluid, and thus insures that the end 37 will not engage seat 39 unless there is a leak in the secondary fluid system.

It is desirable that the spring 35 be properly sized to insure that the piston 34 will be properly positioned to the left before subjecting the isolator 30 to the primary pressure. An insufficient spring force may result in the piston 34 not being properly positioned in the cylinder 31, but an excessive spring force will increase the error difference between the actual primary fluid pressure and the measured secondary fluid pressure. Furthermore, other operating factors will affect the size of the spring 35, such as the mass of the well fluids in the portion of the flow line 16 extending above the surface of the ocean 3.

As hereinbefore explained, the distance which the piston 34 moves within the cylinder 31 is primarily a function of the compressibility of the secondary fluid when primary pressure is initially applied to the piston 34. Thus, it is desirable that the air component of the secondary fluid be kept to a minimum, since the presence of air or other gas in the mixture is a significant factor in establishing the overall compressibility of the secondary fluid.

The secondary fluid reservoir 50 is a particularly significant factor in providing for minimizing the distance which the piston 34 moves in the cylinder 31 when primary pressure is first applied to the system, and therefore in minimizing the error created by the resistance of the spring 35. Compressibility of a fluid, even a gas, is not a linear function, and thus the secondary fluid will experience the greatest degree of compression when the secondary pressure is raised (for example from 0 to 200 PSI). If the system is initially assembled and filled at sea level at 14.7 PSI and subsequently lowered to a subsea pressure of 200 PSI, and a primary pressure is later applied to the piston 34 which is 2,000 PSI or more, the secondary fluid will experience a further shrinkage of about 10% or less than the total shrinkage which it experienced due to the initial rise to 200 PSI. Thus, it will be apparent that if the secondary fluid reservoir 50 has applied an initial pressure of about 200 PSI (for example) to the secondary fluid, before the primary pressure is released onto the piston 34, the piston 34 will travel only a fraction of the distance which it would otherwise move within the cylinder 31 if the secondary fluid had not been subjected to this prepressurizing step.

It will be apparent that any means for suitably prepressurizing the secondary fluid will be appropriate to the present invention, although the secondary fluid reservoir 50 is especially desirable for establishing this pre-pressure at a level corresponding to the ambient subsea pressure on the wellhead assembly 2. In the first place, the present invention may be employed to measure casing pressure at the wellhead 2, and this casing pressure is usually substantially equal to ambient pressure. Since the level of the pre-pressure will normally define the minimum level of pressure which this system can measure, it will usually be desirable that the prepressure level not be greater than the ambient pressure on the wellhead assembly 2.

There are other reasons why the secondary fluid reservoir 50 is a particularly suitable type of pressurizing source for many purposes. First, the secondary fluid reservoir 50 is a passive pressurizing source, in that it does not require an operator to activate the pressurizing function. Second, the accumulator 50 pressurizes the secondary fluid which acts on the secondary fluid side of the piston 34 at the same rate and to the same extent that the water pressure is acting on the primary fluid side of the piston 34. Thus, since the piston 34 is properly positioned within the cylinder 31 while on the surface by the spring 35, the piston 34 will remain properly positioned while the wellhead assembly is lowered into the water. Also, the secondary fluid reservoir 50 produces an equal and opposite force to the water pressure acting on the primary side of the piston 34, regardless of the depth of the wellhead assembly in the water. Third, the secondary fluid reservoir 50 functions to pressurize the secondary fluid to the ambient water pressure, and since it is anticipated that the pressures to be monitored will not be less than the ambient water pressure, the secondary fluid reservoir 50 will not pressurize the secondary fluid to a value greater than the pressure to be monitored. This is particularly significant since the isolator 30 will not transmit the pressure to be monitored (the primary pressure) to the secondary fluid if the pre-pressure on the secondary fluid is greater than primary pressure.

One of the advantages of this invention is that, if damage occurs which renders the pressure monitoring system inoperable, well fluid will not escape into the environment and, therefore, production may be continued notwithstanding. In other words, repairs to the pressure monitoring system may be deferred until the well is required to be shut in for other reasons. Also, a leak in the monitoring system is more easily detected if the system embodies the concept of the present invention, since even a slight leak in the secondary fluid system will result in a pressure decrease on the secondary fluid side of the piston 34, causing the piston to move until the shut-off end 37 sealingly engages the seat 38. Once the shut-off end 37 has engaged the seat 38, it may be appreciated that the secondary fluid chamber pressure will now drop substantially, which pressure drop will be readily detected by the pressure transducer. Finally, the fluid used in the secondary fluid chamber can be far less corrosive than are many well fluids, and will therefore be less likely to inherently damage the system. More particularly, when the pressure transducer within the module 55 containing electronic and hydraulic apparatus, the isolator 30 prevents the well fluid from entering the module in the event of leak in the secondary fluid system. Thus, the isolator 30 protects the electronic and hydraulic apparatus from within the module 55 from the deleterious well fluid.

Referring again to FIG. 3, it should be noted that the purpose of the U-shaped high pressure seals 70 and 71 is to confine well fluid to the isolator 60, and from the surrounding water, in the event of a leak in the secondary fluid chamber. The seal created by shut-off end 77 and seat 78 is additional protection in the event that the high pressure seals 70 and 71 deteriorate during the interval between the time the system fails and the time when repairs are made.

Even if after a time, the seals 70 and 71 deteriorate and a major leak subsequently develops in the secondary fluid system, shut-off end 77 will engage the seat 78 so long as the flow rate through the leak exceeds the flow rate through the seals.

Referring again to apparatus in FIG. 3, it may be noted that the dynamic seals 70 and 71 may be easily placed on the sleeve 69, and then the sleeve 69 with the dynamic seals 70 and 71 may be brought into engagement with the piston head 67 and secured by threading the piston nut 73 on the shaft 76. The piston nut 73 may be conveniently constructed to provide support for the spring 75, so that the piston nut 73 and the interior of the cylinder housing 61 may both prevent the spring 75 from distorting when the spring 75 is compressed.

It may be appreciated that the shut-off end 68 will provide a metal to metal back-up seal in the event the secondary fluid were to leak past the dynamic seals 70 and 71 when the secondary fluid is being pre-pressurized. Also, when the shut-off end 68 seals against the seat 66, the piston head 67 does not block the passage 64. Since the primary fluid pressure is applied to the area of the piston head 67 which is larger than the area of the opening 64, the primary pressure required to unseat the shut-off end 68 from the seat 66 is less than the primary pressure that would be required if the piston head 67 sealingly engaged a seat located at the end of the passage 64. Once the shut-off end 68 is not in contact with the seat 66, the piston may move in either direction in response to a subsequent increased or decreased primary pressure. Also, it may be noted that the cross-sectional area of the shut-off end 77 and the corresponding seat 78 may be increased so that the secondary fluid pressure may more easily unseat the shut-off end 77 from the seat 78, in order that the secondary fluid pressure may then act on the secondary fluid side of the piston to properly position the piston within the isolator.

Referring again to FIG. 5, it may be noted that the secondary fluid chamber may be supplied by a pump 99 which may be located either on the surface or at the wellhead assembly 2. Thus, the secondary fluid pressure may be increased by pump 99 until both pistons 92 and 93 are properly positioned within the cylinder 91, and spring 97 may also be included in the isolator 90 to aid in properly positioning pistons 92 and 93. An advantage in using the pump 99 as the pressurizing means is that the spring 97 may be eliminated and, since the force of the spring 97 is a significant error factor, the difference between the actual primary pressure and the secondary pressure being measured is reduced, and this will effectively eliminate a significant portion of the error in the measurement system.

Another advantage of the embodiment shown in FIG. 5 is that containment of the well fluid is more effective with two pistons each having double dynamic seals. Also, a buffer liquid 94 may be used which does not attack the dynamic seals, and which also acts as an additional barrier to the well fluids.

In FIG. 6, an accumulator or secondary fluid reservoir 171 may be provided which employs piston 172 and which is open at one end to ambient subsea pressure. However, it should be noted that the piston 172 may be constructed with a head portion 173 having a large surface area on the side exposed to ambient pressure, and a stem portion 174 having a small surface area on the secondary fluid side. Since the piston 172 will move within the secondary fluid reservoir 171 until the forces on both sides of the piston 172 are equal, it may be seen that the secondary fluid reservoir 171 is capable of subjecting the secondary fluid to a pressure greater than the ambient water pressure. As noted earlier, the secondary fluid reservoir 171 serves to pressurize the secondary fluid before subjecting the isolator 120 to the primary fluid, and thus serves to reduce the travel of the piston 122.

One advantage of the secondary fluid reservoir 171 is that the pre-pressure on the secondary fluid is not limited to the sea pressure, and thus the amount of travel by the piston 122 can be reduced by employing the secondary fluid reservoir 171, since the pre-pressure may be greater than the sea pressure. Accordingly, although the secondary fluid reservoir 171 is a passive device which is responsive to ambient pressure, the piston 172 acts to establish a secondary pre-pressure which is greater than ambient pressure by a difference functionally related to the difference between the cross-sectional areas of the head portion 173 and the stem portion 174. Thus, if the secondary fluid reservoir 172 is used in conjunction with the isolator 30, the spring 35 may not be required insofar as the function of the spring is merely to properly pre-position the piston 34.

It should be noted that when the isolator 120 is employed in the system, the pressure transducer 45 can measure a primary pressure which is actually lower than the secondary pressure, in contrast with isolators 30, and 90, which are depicted in FIGS. 2 and 5 respectively. In other words, the force which is required to unseat the shut-off end 124 of the piston assembly 122 will be the sum of the tension in the spring 126 plus a sufficient primary pressure which, however, may be less than the secondary pressure. Furthermore, the error factor attributable to the spring 126 will actually decrease as the primary pressure increases to drive the piston 122 toward the exit port seat 128, and will become zero if the spring 126 relaxes completely.

Referring again to the isolator 120, it should be noted that the spring 126 is positioned to act against the well fluid side of the isolator, rather than against the side which confronts secondary pressure, whereby the spring 126 in the isolator 120 will allow the isolator to transmit a well fluid pressure which may be less than the pre-pressure applied by the pressurizing means, as will hereinafter be explained. When on the surface, the spring 126 may apply a spring force against the piston 122 forcing the piston 122 to move to the right until the shut-off end 128 engages the seat 129. If the secondary fluid is subsequently pressurized to a value greater than the ambient pressure, the piston 122 will travel to the left in response to the increased secondary fluid pressure while also increasing the opposing pressure of the spring 126. It will be noted that the piston may now achieve a temporary position as shown in FIG. 6, with neither shut-off end 128 or 124 in engagement with its respective seat. The well fluid pressure may now be applied to the primary fluid side of the piston 122, and the piston 122 is capable of transmitting that pressure to the secondary fluid regardless of whether the well fluid pressure is more or less than the pre-pressurized secondary fluid pressure. For instance, assume that the cross-sectional area of the piston 122 is half a square inch, and the secondary fluid reservoir 171 is placed in water at an ambient pressure of 50 PSIA, but the ends of the piston 172 are sized to pressurize the secondary fluid to 300 PSIA. The secondary fluid pressure now produces a force of 150 lbs. against the secondary fluid side of the piston 122, and the water pressure of 50 PSIA produces an opposing force of 25 lbs. The piston 122 may therefore move to the left until a spring force of 125 lbs. is reached, at which time the piston position is stabilized. Now, if a well fluid pressure of 100 PSIA acts against a piston, the secondary fluid pressure will increase from 300 PSIA to 350 PSIA to reflect the additional pressure applied to the piston. Likewise, if the well fluid pressure increases to 200 PSIA, the secondary fluid pressure will increase to 450 PSIA. (In the above example, it is assumed that the force applied by the spring 126 is constant, and the negligible difference caused by the minute movement of the piston 122 causing a slight expansion of Referring now to FIG. 7, there may be seen another different isolator 130 having a piston 133 with a right-end shaft 139 and shut-off end 140, and further having a left-end shaft 134 with shut-off end 137 extending slidably through a wall 135 and seal 136 in the cylinder body 131. Thus, only the shaft 134 is subject to the primary pressure, and since the cross-sectional area of shaft 134 is less than the cross-sectional area of the proportionally higher primary pressure to drive the piston piston 133, it may be seen that it will require a 133 to enhance the secondary pressure, than if the primary pressure is applied directly to the head of the piston 133 as in the other embodiments of the present invention.

It may be seen that the isolator 130 will permit high well fluid pressure to be monitored while the secondary fluid is subject to a pressure which is only a fraction of the actual primary pressure, which decreases the risk of causing a leak in the secondary fluid system. In this regard, the pressure transducer 45 or its related circuitry (not depicted) may be calibrated to indicate the actual primary or well fluid pressure, even though it is actually monitoring a lower secondary fluid pressure. Accordingly, it is also within the concept of the present invention to employ an isolator (not depicted) wherein the large end of its piston is subjected to the well fluid, and wherein the smaller end or shaft is used to pressurize the secondary fluid. In such a case, the secondary fluid pressure will increase in response to the well fluid pressure at a rate greater than, but still functionally related to, the well fluid pressure.

FIG. 7 also shows an accumulator 143 which may be used to pressurize the secondary fluid. Accumulator 143 may be pressurized while on the surface, and valve 142 opened when the isolator 130 and pressure transducer 45 are fully connected as shown in FIG. 7. The accumulator 143 does not rely on the ambient pressure to pressurize the secondary fluid, and yet it is a passive device in the sense that the stored pressure inside the accumulator 143 is sufficient to pressurize the secondary fluid.

It is readily apparent that any of the isolators described above may be used in combination with any of the pressurizing means also described. The particular combination selected will depend, to a large extent, on the desired accuracy of the system and the desirability of a passive pressurizing means. Although a variety of different materials may be used in fabricating of the various components of the apparatus hereinbefore described, stainless steel or Monel metal may be particularly suited to uses in deleterious environments such as that suggested in FIG. 1.

It should be understood that the instant invention is suitable for monitoring any pressure in various circumstances and that the invention is not limited to subsea or petroleum recovery operations only. Also, a wide variety of secondary fluids may be used, and silicone oil and hydraulic oil are suggested only as an examples of suitable material for the secondary fluid. The pressure transducer may be of any type which is capable of measuring a fluid pressure, and is not limited to a device which provides an electrical output signal. Further, the present invention has application regardless of the specific degree of compressibility of the secondary fluid, and may be utilized with a secondary fluid having little or no gaseous component.

Many other alternative forms of the present invention will, of course, be apparent from the foregoing methods and apparatus. Accordingly, the structures and techniques hereinbefore depicted and discussed are illustrative only, and are not intended as limitations on the scope of the present invention.

What is claimed is:

1. A method of monitoring and controlling a primary pressure in a subsea system containing a primary fluid, comprising establishing a secondary fluid isolated from said primary fluid by a yeildable barrier therebetween, establishing and maintaining an initial pressure on said secondary fluid substantially reducing the further compressibility of said secondary fluid, thereafter applying said primary pressure to said yeildable barrier for increasing the pressure on said secondary fluid in a manner functionally related to said primary pressure, deriving an indication of the pressure on said secondary fluid as a function of said primary pressure in said system, and controlling said primary pressure in response to said indication of the pressure on said secondary fluid.

2. The method described in claim 1, further comprising establishing and maintaining said initial pressure as a function of ambient pressure on said subsea system.

3. The method described in claim 1, further comprising biasing said yieldable barrier toward said primary fluid, and establishing and maintaining said initial pressure at a magnitude substantially equal to ambient pressure on said subsea system.

4. A method of monitoring wellhead pressure in a subsea petroleum system, comprising establishing a secondary fluid separate from a well fluid under said wellhead pressure, establishing a barrier between said well fluid and said secondary fluid yieldable within predetermined limits, biasing said barrier within said predetermined limits, establishing a initial pressure on said secondary fluid as a function of ambient subsea pressure, thereafter urging said barrier within said limits and against said secondary fluid in response to said wellhead pressure, and deriving an indication of the pressure on said secondary fluid as a function of said wellhead pressure 5. The method described in claim 4, further comprising biasing said barrier toward said well fluid, and establishing said initial pressure on said secondary fluid in response to said ambient subsea pressure.

6. The method described in claim 4, further comprising sealing said well fluid within said wellhead by urging said barrier to one of said limits.

7. In a petroleum recovery system having a subsea wellhead and the like containing a petroleum fluid under a primary pressure, apparatus for monitoring said primary pressure comprising a secondary fluid chamber adapted to contain a secondary fluid, isolator means disposed between said petroleum fluid and said secondary fluid for establishing a secondary pressure in said secondary fluid chamber at a level functionally related to said primary pressure, pressure transducing means responsive to said secondary pressure for deriving an indication of said secondary pressure, and pressurizing means interconnected with said pressure chamber for subjecting said secondary fluid to an initial pressure of a magnitude functionally related to the ambient subsea pressure.

8. The apparatus described in claim 7, wherein said isolator means comprises housing means having an inlet port in fluid communication with said petroleum fluid and further having an outlet port in fluid communication with said secondary fluid.

9. The apparatus described in claim 8, wherein said pressure member comprises piston means slidably movable within said housing means, and shutoff means affixed to said piston means and sealingly engageable with said outlet port for maintaining said petroleum fluid within said wellhead.

10. The apparatus described in claim 7, wherein said pressurizing means is further responsive to said ambient subsea pressure.

11. The apparatus described in claim 7, wherein said pressurizing means is interconnected with said pressure chamber for subjecting the secondary fluid to said initial pressure at a magnitude substantially equal to ambient subsea pressure.

12. In a petroleum recovery system having a wellhead containing a petroleum fluid under a primary pressure, apparatus for monitoring said primary pressure comprising a secondary fluid chamber adapted to contain a secondary fluid under a secondary pressure, isolator means disposed between said petroleum fluid and said secondary fluid and having a movable piston member responsive to said primary pressure and trapping said petroleum fluid within said wellhead and from said secondary fluid, measuring means interconnected with said secondary fluid chamber and responsive to said secondary fluid pressure, and biasing means within said isolator means for acting on said piston member.

13. The apparatus described in claim 12, further comprising pressurizing means interconnected with said secondary fluid chamber for subjecting said secondary fluid to an initial pressure substantially reducing the further compressibility of said secondary fluid.

14. In a petroleum recovery system having a subsea wellhead containing a petroleum fluid under a primary pressure, apparatus for monitoring and controlling said primary pressure comprising a secondary fluid chamber adapted to contain a secondary fluid, isolator means disposed between said petroleum fluid and said secondary fluid and having barrier means yieldable through predetermined limits for establishing a secondary pressure on said secondary fluid at a level functionally related to said primary pressure, measuring means interconnected to said secondary fluid chamber for deriving and indication of said pressure on said secondary fluid, biasing means in said isolator means maintaining a force on said barrier means, pressurizing means interconnected with said secondary fluid chamber for reducing the force of said biasing means on said barrier means when monitoring said primary pressure, and valve means for controlling said primary pressure in response to said indication of said pressure on said secondary fluid.

15. The apparatus described in claim 13, wherein said pressurizing means reduces the force of said biasing means on said barrier means by subjecting said secondary fluid to an initial pressure.

16. The apparatus described in claim 15 wherein said pressurizing means is responsive to ambient subsea pressure.

17. The apparatus described in claim 15, wherein said pressurizing means subjects said secondary fluid to said initial pressure at a level substantially equal to ambient subsea pressure.

18. The apparatus described in claim 15, wherein said biasing means comprises a spring.

19. The apparatus described in claim 18, wherein said isolator means comprises housing means having an inlet port in fluid communication with said petroleum fluid and further having an outlet port in fluid communication with said secondary fluid.

20. The apparatus described in claim 19, further comprising shutoff means sealingly engageable with said outlet port for maintaining said petroleum fluid within said wellhead.

21. The apparatus described in claim 20, wherein said barrier means comprises a piston slidable within said housing means and affixed to said shutoff means.

22. In a subsea petroleum production installation, apparatus for monitoring the pressure of a primary fluid, comprising a control module including control circuitry immersed in a protective fluid, pressure transducing means for sensing the pressure of a secondary fluid, means for generating an electrical signal representative of said pressure of said secondary fluid and transmitting said signal to said control circuitry, isolation means coupled between said primary fluid and said secondary fluid for subjecting said secondary fluid to a pressure functionally related to said pressure on said primary fluid, shutoff means for retaining said primary fluid within said production installation in the event of a leak in said secondary fluid chamber, and means responsive to said control circuitry for varying selected operating parameters of said subsea petroleum production installation.

23. The apparatus described in claim 22, further comprising yieldable barrier means within said isolation means precluding intermixing of said primary fluid and said secondary fluid.

24. The apparatus described in claim 23, further comprising pressurizing means for subjecting said secondary fluid to an initial pressure substantially equal to ambient subsea pressure on said pressurizing means.

25. The apparatus described in claim 23, further comprising pressurizing means for subjecting said secondary fluid to said initial pressure functionally related to ambient subsea pressure.

26. The apparatus described in claim 25, further comprising biasing means within said isolator means for positioning said barrier means.

27. The apparatus described in claim 22, wherein said means responsive to said control circuitry comprises, valve means for controlling said pressure of said primary fluid.

28. In a petroleum installation and the like, apparatus for monitoring a primary pressure on a petroluem fluid comprising a module including control circuitry immersed in a protective fluid, pressure transducer means within said module for generating a signal in response to a secondary fluid pressure, conduit means interconnected with said transducer means for containing a secondary fluid, isolator means interconnected with said installation and said conduit means and having piston means slidably separating said petroleum fluids and said secondary fluid and subjecting said secondary fluid to a secondary pressure functionally related to said wellhead pressure, and shutoff means within said isolator means for automatically retaining said petroleum fluid within said installation in the event of a leak in said conduit means.

29. The apparatus described in claim 28, further comprising, pressurizing means connected to said conduit means for subjecting said secondary fluid to an initial pressure substantially reducing the further compressibility of said secondary fluid.

30. The apparatus described in claim 29, wherein said isolator means comprises, housing means having an inlet port in fluid communication with said petroleum fluid and an outlet port in fluid communication with said secondary fluid, and biasing means for positioning said piston means.

31. The apparatus described in claim 30, wherein said shutoff means sealingly engages said outlet port for retaining said petroleum fluid within said installation.

32. In a subsea petroluem production installation, the combination of:

a first chamber for containing a quantity of primary fluid and adapted to be connected in a fluid communication with a primary fluid conduit of said installation, a second chamber for containing a secondary fluid, a control module including control circuitry immersed in a protective dielectric fluid, pressure transducing means for sensing variations in the pressure of said secondary fluid, generating electrical signals representative of such variations, and transmitting said signals to said control circuitry, and isolation means for subjecting said secondary fluid to a pressure that varies as a predetermined function of the pressure of said primary fluid and providing a static seal between said first and second chambers when the pressure differential therebetween exceeds a predetermined magnitude.

33. The combination described in claim 32, wherein said pressure transducing means is contained within said control module.

34. The combination described in claim 32, further comprising, pressurizing means for subjecting said secondary fluid to an initial pressure at a magnitude functionally related to the ambient subsea pressure.

35. As a subcombination, a first chamber for containing a quantity of primary fluid and adapted to be connected in fluid communication with a primary fluid conduit in a subsea petroleum production installation, a second chamber for containing a quantity of secondary fluid and adapted to be connected in fluid communication with a pressure sensing means, isolation means having a barrier member yieldable through predetermined limits for subjecting said secondary fluid to a pressure that varies as a predetermined function of pressure on said primary fluid, shut-off means actuated by movement of said barrier member for providing a seal between said primary fluid and said secondary fluid when the pressure differential between said first and second chambers exceeds a predetermined magnitude, and biasing means within one of said chambers for prepositioning said barrier member.

36. The subcombination defined in claim 35, wherein said barrier member comprises a piston member slidable within said isolation means and said shut-off means comprises an elongated annular sleeve portion positioned within said second chamber.

37. The subcombination defined in claim 36, wherein said biasing means is enclosed within said annular sleeve portion, and said seal is formed by metal to metal engagement of said annular sleeve portion with an annular seat formed on an internal surface of said second chamber.

38. In an apparatus for use in a subsea petroleum production installation, the subcombination comprising an elongated housing formed to define a substantially cylindrical interior cavity, said housing having at one end of said cavity a first fluid port adapted to be connected in fluid communication with a primary fluid conduit of said installation and having at the other end of said cavity a second fluid port adapted to be connected in fluid communication with a secondary fluid conduit;

a longitudinally movable piston dividing said cavity into first and second chambers for separately containing, respectively, a quantity of primary fluid and a quantity of secondary fluid, with said piston being movable in response to primary fluid pressure variations and thereby subjecting said secondary fluid to a pressure that varies as a function of primary fluid pressure;

an annular seat formed on an internal surface of said second chamber;

an elongated annular sleeve-like element which includes shut-off means for engaging said seat when the pressure differential between said first and second chambers exceeds a predetermined magnitude; and biasing means within said cavity acting upon said piston for urging said shut-off means away from said seat.

39. As a subcombination, housing means having an inlet port in fluid communication with a primary fluid in a subsea petroleum installation and further having an outlet port in fluid communication with a secondary fluid, a first chamber within said housing means for containing a quantity of primary fluid, a second chamber within said housing means for containing a quantity of secondary fluid, a barrier member between said first and second chambers yieldable through predetermined limits for subjecting said secondary fluid to a pressure that varies as a predetermined function of pressure on said primary fluid, a shut-off seat formed on an internal surface of said second chamber, a sleeve member connected to be actuated by said barrier member and having a shut-off end for engagement with said shut-off seat and thereby sealing said primary fluid from said secondary fluid when the pressure differential between said first and second chambers exceed a predetermined magnitude, and biasing means within said housing means for urging said barrier member away from said shut-off seat.

* * * * *